United States Patent [19]

Sugiyama et al.

[11] Patent Number: 4,614,955

[45] Date of Patent: Sep. 30, 1986

[54] HEAT SENSITIVE RECORDING PAPER

[75] Inventors: Takekatsu Sugiyama; Hiroharu Matsukawa, both of Shizuoka, Japan

[73] Assignee: Fuji Photo Film Co., Ltd., Kanagawa, Japan

[21] Appl. No.: 658,242

[22] Filed: Oct. 5, 1984

[30] Foreign Application Priority Data

Oct. 5, 1983 [JP] Japan ..... 58-187518

[51] Int. Cl.[4] ..... B41M 5/18

[52] U.S. Cl. ..... 346/200; 346/209; 346/226; 427/150; 427/151; 427/152; 428/537.5; 428/537.7

[58] Field of Search ..... 346/208, 209, 225, 200, 346/226; 427/150, 151, 152; 428/537.5, 537.7

[56] References Cited

U.S. PATENT DOCUMENTS 4,567,496 1/1986 Ogata et al. ..... 428/537.5

4,567,497 1/1986 Tamagawa et al. ..... 346/200

FOREIGN PATENT DOCUMENTS 768244 3/1971 France ..... 346/209

0098393 6/1982 Japan ..... 346/200

0011193 1/1983 Japan ..... 346/209

*Primary Examiner*—Bruce H. Hess

*Attorney, Agent, or Firm*—Sughrue, Mion, Zinn, Macpeak & Seas

[57] ABSTRACT

A heat sensitive recording paper is described comprising a support and a heat sensitive recording layer containing a colorless or light colored electron-donating dye and a phenolic compound, said recording paper containing a sodium or potassium salt of a monovalent or divalent organic carboxylic acid having from 2 to 15 carbon atoms in at least one of the support and the recording layer, to obtain a desired gain in conductivity without being attended by a drop in coating facility.

5 Claims, No Drawings

HEAT SENSITIVE RECORDING PAPER

FIELD OF THE INVENTION

The present invention relates to a heat sensitive recording paper, and more particularly to a heat sensitive recording paper having low charging capability and excellent production facility.

BACKGROUND OF THE INVENTION

Heat sensitive recording papers form a record of images by taking advantage of a physical or a chemical change of matter caused by application of thermal energy thereto, and a great many processes therefor have been studied.

As for a process of utilizing a physical change caused in a substance by applied heat, the so-called wax type of heat sensitive paper has long been known, and particularly has been used for recording electrocardiograms or the like. On the other hand, various kinds of coloring mechanisms through which images can be recorded have been proposed as processes of utilizing a chemical change caused by heat, with the so-called two-component coloring type of heat sensitive recording paper being especially representative thereof.

In the two-component coloring type of heat sensitive recording paper, a record can be obtained by taking advantage of a color reaction which takes place under such circumstances that two kinds of thermally reactive compounds which are dispersed as fine particles isolated from each other by the binder or the like are coated on a support and thereto, heat is applied to melt either or both of the compounds, which thereby come into contact with each other. In general, such two kinds of thermally reactive compounds are a so-called electron-donating compound and a so-called electron-accepting compound.

The two-component coloring type of heat sensitive recording paper as described above has many advantages, in that: (1) the color reaction obeys a first-order kinetics and therefore, no developing step is required; (2) the quality of the recording paper is akin to that of plain paper; (3) the recording paper can be handled with ease; and so on. When colorless dyes are used as the electron-donating compound, the recording paper has further advantages, in that: (4) color density is high; and (5) a wide variety of hues can be easily obtained by the color reaction, which further enhances the utility value of the recording paper of such kind. Accordingly, it has been most frequently employed as a heat sensitive recording material.

In recent years, heat sensitive recording papers have been in increasing demand, particularly in the arts of facsimile transmission equipment, recorders, and printers.

On the other hand, recent advances in integration techniques has increased the tendency toward miniaturizing recorders installed in facsimile transmission equipment, printers, etc., in spite of providing it with many functions.

Integration and miniatuarization of recorders have posed a new problem that mis-operation and production problems are caused by static electricity generated in a recording system including the recorder and the recording paper.

As a measure to counter such troubles, it has generally been carried out to suppress generation of static electricity by imparting electrical conductivity to a heat sensitive recording paper.

A conventionally known method for imparting electrical conductivity to a heat sensitive paper involves addition of a conductive compound, such as a water-soluble inorganic salt, a metal or a metal oxide, a cationic surface active agent such as a quaternary ammonium salt, a nonionic surface active agent like polyethylene glycol, polypropylene glycol, etc., or an anionic surface active agent like a sulfonate (as described in Japanese Patent Application (OPI) Nos. 148687/82, 156292/82 and 170794/82 (the term "OPI" as used herein refers to a "published unexamined Japanese patent application")).

However, those conductive compounds suffer from defects that they do not always have a sufficient conductivity effect to prevent static electricity from being generated in a heat sensitive paper; or, if they do produce a sufficient conductivity effect, they may have an adverse effect on coating facility due to increasing the viscosity of the coating composition or a condensation phenomenon which are caused by addition thereof, and so on. Therefore, these conventional methods have not been completed satisfactory.

SUMMARY OF THE INVENTION

One object of the present invention is to provide a heat sensitive recording paper which is produced using a conductive agent which does not cause an increase of viscosity and a condensation phenomenon when added to a coating solution to be used for production of a heat sensitive recording paper or pulp slurry to be used for making support base, and thereby provides both sufficient conductivity and production facility.

It has now been found that sodium or potassium salts of monovalent or divalent carboxylic acids containing from 2 to 15 carbon atoms, preferably 2 to 8 carbon atoms, are appropriate to be used as a compound which can impart sufficient conductivity while not causing increases in the viscosity of the slurry or the like or a condensation phenomenon therein when added to pulp slurry at the time of making a support for a heat sensitive recording paper by means of a paper machine, previously coated on raw paper using a double side or single side size press or the like, or added to a heat sensitive coating composition.

That is, the above-described object is attained with a heat sensitive recording paper comprising a support and a heat sensitive recording layer containing a colorless or light colored electron-donating dye and a phenolic compound, said recording paper containing a sodium or potassium salt of a monovalent or divalent organic carboxylic acid having from 2 to 15 carbon atoms in at least one of the support and the recording layer.

DETAILED DESCRIPTION OF THE INVENTION

If the conductive compound to be employed in the present invention is incorporated in either the support or heat sensitive recording layer, or both, the effect of the present invention can be produced. Suitable methods for incorporating the conductive compound into a support include a method of adding the conductive compound to pulp slurry, coating a solution of the conductive compound by means of a size press or the like after making paper, and so on. Incorporation of the conductive compound into a heat sensitive recording layer is generally carried out using a method of adding the conductive compound to a heat sensitive coating composition before coating. In order to achieve the object of the present invention, the conductive compound is generally used in an amount such that the sodium or potassium ion content is from 0.05 to 0.5 g per square meter, and preferably from 0.07 to 0.3 g per square meter. Of the conductive compounds which can be used in the present invention, those having not more than 10 carbon atoms per carboxylic acid group are more desirable from the viewpoint of high solubility in water.

Specific examples of conductive compounds which can be used in the present invention include those described below. However, the present invention should not be construed as being limited to the following examples.

(1) Sodium or potassium salts of monovalent carboxylic acids such as acetic acid, propionic acid, butyric acid, valeric acid, caproic acid, caplylic acid, benzoic acid, toluic acid, salicylic acid, naphthoic acid and so on.
(2) Sodium or potassium salts of divalent carboxylic acids such as oxalic acid, malonic acid, succinic acid, glutaric acid, adipic acid, phthalic acid, terephthalic acid, naphthalenedicarboxylic acid and so on, in which two metal ions may be the same or different.
(3) Sodium or potassium salts of carbonic acid monoesters such as monomethyl carbonate, monoethyl carbonate, and the like.

The heat sensitive recording material of the present invention can be produced, e.g., as follows. A colorless or light colored electron-donating dye and a phenolic compound are dispersed in separate solutions of a water-soluble high polymer (binder) using a means such as a ball mill. The dispersing step is continued until the volume average particle size becomes 5 μm or less, and more preferably 2 μm or less. After conclusion of the individual dispersion steps, the resulting dispersions are mixed to prepare a heat sensitive coating composition.

The thus prepared coating composition is coated on a support such as a sheet of paper or synthetic paper, plastic film or the like, and then dried. Thus, an intended heat sensitive recording material is obtained.

Suitable examples of colorless or light colored electron-donating dyes which can be used in the present invention include triarylmethane type compounds, diphenylmethane type compounds, xanthene compounds, thiazine compounds, spiropyran compounds and so on. More specifically, they include, e.g., 3,3-bis(p-dimethylaminophenyl)-6-dimethylaminophthalide (i.e., Crystal Violet lactone), 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3-(p-dimethylaminophenyl)-3-(2-phenylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-5-dimethylaminophthalide, 3,3-bis(2-phenylindole-3-yl)-5-dimethylaminophthalide, 3-p-dimethylaminophenyl-3-(1-methylpyrrole-2-yl)-6-dimethylaminophthalide, 3-diethylamino-7-methoxyfluoran, 3-diethylamino-6-methoxyfluoran, 3-diethylamino-7-dibenzylaminofluoran, 3-diethylamino-6-methyl-7-anilinofluoran, 3-N-ethyl-N-tolylamino-6-methyl-7-anilinofluoran, 3-N-methyl-N-tolylamino-6-methyl-7-anilinofluoran, 3-piperidino-6-methyl-7-anilinofluoran, 3-diethylamino-6-chloro-7-anilinofluoran, 3-N-cyclohexyl-N-methylamino-6-methyl-7-anilinofluoran, 3-piperazino-6-methyl-7-(p-methylanilino)fluoran, 3-diethylamino-7-(o-chloroanilino)fluoran, 3-diethylamino-7-butylaminofluoran, 3-diethylamino-7-diphenetylaminofluoran, 3,7-bis(methyltolylamino)fluoran, 3-piperidino-7-phenetylaminofluoran, 3-diethylamino-7-phenylfluoran, 3-diethylamino-7,8-benzofluoran, and so on.

These dyes may be used individually, or in the form of mixtures thereof for purpose of color tone adjustment.

Phenol compounds which can be used in the present invention are preferably bisphenol compounds. Specific examples of such bisphenol compounds include 2,2-bis(4'-hydroxyphenyl)propane (bisphenol A), 2,2-bis(4-hydroxyphenyl)pentane, 2,2-bis(4'-hydroxy-3',5'-dichlorophenyl)propane, 1,1-bis(4'-hydroxyphenyl)cyclohexane, 2,2-bis(4'-hydroxyphenyl)hexane, 1,1-bis(4'-hydroxyphenyl)propane, 1,1-bis(4'-hydroxyphenyl)butane, 1,1-bis(4'-hydroxyphenyl)pentane, 1,1-bis(4'-hydroxyphenyl)hexane, 1,1-bis(4'-hydroxyphenyl)heptane, 1,1-bis(4'-hydroxyphenyl)octane, 1,1-bis(4'-hydroxyphenyl)-2-methylpentane, 1,1-bis(4-hydroxyphenyl)-2-ethyl-hexane, 1,1-bis(4'-hydroxyphenyl)dodecane and the like.

A recording layer of the heat sensitive recording paper of the present invention contains a water-soluble binder. Binders fit for such a water-soluble binder are those which can be dissolved in 25° C. water in a proportion of 5 wt% or above. More specifically, methyl cellulose, carboxymethyl cellulose, hydroxyethyl cellulose, starch, gelatin, gum arabic, casein, hydrolysis products of styrene-maleic anhydride copolymers, hydrolysis products of ethylene-maleic anhydride copolymers, hydrolysis products of isobutylene-maleic anhydride copolymers, polyvinyl alcohol, carboxy denatured polyvinyl alcohol (polyvinyl alcohol/acrylic acid copolymer) and so on can be employed as the binder.

Further, the recording layer of the heat sensitive recording paper of the present invention can optionally contain additives for making improvement in heat responsiveness, pigments, water-insoluble binders, metal soaps and so on.

Suitable examples of additives which can be used for making improvement in heat responsiveness include natural waxes such as animal waxes, vegetable waxes, petroleum waxes and so on, synthetic waxes, alkylcarboxylic acid anilides, alkylcarboxylic acid amides, and the like.

Suitable examples of pigments which can be used include zinc oxide, calcium carbonate, barium sulfate, titanium oxide, lithopone, talc, agalmatolite, kaolin, aluminum hydroxide and so on.

As for the water-insoluble binder, synthetic rubber latexes or synthetic resin emulsions are generally used. Specific examples thereof include styrene-butadiene rubber latex, acylonitrile-butadiene rubber latex, methylacrylate-butadiene rubber latex, vinyl acetate emulsion, and so on.

Suitable examples of metal soaps include metal salts of higher fatty acids such as zinc stearate, calcium stearate, aluminum stearate, etc., which are used in a form of emulsions.

The present invention is illustrated in greater detail by reference to the following examples. However, the present invention should not be construed as being limited to the following examples.

EXAMPLE 1

20 g of 3-diethylamino-6-chloro-7-anilinofluoran was dispersed together with 100 g of a 5% aqueous solution of polyvinyl alcohol (polymerization degree: 1000, saponification degree: 99%) for about 24 hours by means of a ball mill to prepare Dispersion A.

40 g of bisphenol A and 40 g of stearic acid amide were dispersed together with 400 g of a 5% aqueous solution of polyvinyl alcohol for about 24 hours by means of a ball mill to prepare Dispersion B.

The thus prepared Dispersion A and Dispersion B were mixed and thereto, 120 g of calcium carbonate and 600 g of a 5% aqueous solution of polyvinyl alcohol were added. These ingredients were thoroughly dispersed to prepare Dispersion C.

To Dispersion C, 70 g of a 20% aqueous solution of sodium butyrate was added, and mixed intimately therewith with stirring to prepare Dispersion D.

The thus obtained Dispersion D was coated on wood free paper having a basis weight of 50 g/m$^2$ in such an amount that the coverage became 6 g/m$^2$ on a solids basis, dried at 50° C., and then subjected to a calendering processing to prepare a heat sensitive recording paper.

EXAMPLE 2

To Dispersion C obtained in the manner employed in Example 1, 100 g of a 20% aqueous solution of sodium benzoate was added to prepare Dispersion E. Another heat sensitive recording paper was prepared using Dispersion E in the same manner as in Example 1.

EXAMPLE 3

A support was prepared using a size press to which the same conductive compound as used in Example 1 (sodium butyrate) was added, in such a manner that the conductive compound was coated on wood free paper having a basis weight of 50 g/m$^2$ at a coverage of 0.3 g/m$^2$, and a heat sensitive recording composition (Dispersion C) was coated thereon to produce a heat sensitive recording paper. This paper was also examined for intended effects.

COMPARATIVE EXAMPLE 1

To Dispersion C obtained using the method of Example 1, 100 g of alumina sol (produced by Nissan Chemical Industries, Ltd.) was added as a conductive agent. Thereupon, the dispersion condensed to a substantial extent. Thus, a desired coating composition was unable to be obtained.

COMPARATIVE EXAMPLE 2

To Dispersion C obtained using the method of Example 1, 100 g of a 15% aqueous solution of sodium sulfate was added to prepare Dispersion F. Using the resulting dispersion, a heat sensitive recording paper was produced in the same manner as in Example 1.

COMPARATIVE EXAMPLE 3

To Dispersion C obtained using the method of Example 1, 90 g of sodium polystyrenesulfonate (a 30% aqueous solution, produced by Toyo Soda Manufacturing Co., Ltd.) was added to prepare Dispersion G. Using the resulting dispersion, a heat sensitive recording paper was produced in the same manner as in Example 1.

COMPARATIVE EXAMPLE 4

Using Dispersion C obtained using the method of Example 1 in which no conductive compound was incorporated, a heat sensitive recording paper was produced in the same manner as in Example 1.

Viscosities of respective coating compositions used in examples and comparative examples were measured at 25° C. using a B-type rotational viscometer made by Toyo Keiki Co., Ltd. Surface resistance of each heat sensitive recording paper was measured using an Electrometer-TR-8651 made by Takeda Riken Co., Ltd. after a moisture content in each recording paper was controlled by being allowed to stand for 2 hours or longer in a room thermostated at 20° C. and kept at a constant percentage (60%) of relative humidity (RH). In addition, the change in fog density of white background areas of each heat sensitive recording paper was measured using a Macbeth RD-514 densitometer.

The results obtained are shown in Table 1.

TABLE 1

| | | | Properties of Heat Sensitive Recording Paper | | |
|---|---|---|---|---|---|
| | | Viscosity of Coating Composition (CPS) | Surface Resistance (Ω) | Background Fog | Background Fog After Pre-use Storage at 40° C., 90% RH for 24 hrs. |
| Example 1 | Dispersion D | 49 | $8 \times 10^9$ | 0.09 | 0.11 |
| Example 2 | Dispersion E | 60 | $1.2 \times 10^{10}$ | 0.09 | 0.11 |
| Example 3 | Dispersion C | 55 | $9 \times 10^{10}$ | 0.09 | 0.11 |
| Comparative Example 2 | Dispersion F | 100 | $8 \times 10^9$ | 0.09 | 0.11 |
| Comparative Example 3 | Dispersion G | 70 | $1 \times 10^{10}$ | 0.14 | 0.16 |
| Comparative Example 4 | Dispersion C | 55 | $1.2 \times 10^{11}$ | 0.09 | 0.11 |

As can be seen from the data in Table 1, it is apparent that the conductive compounds of the present invention have excellent conductive effect, do not cause increase in viscosity of the resulting coating composition, and have little or no influence on generation of fog in the finished heat sensitive recording paper upon storage, that is to say, they have excellent efficiency.

While the invention has been described in detail and with reference to specific embodiments thereof, it will be apparent to one skilled in the art that various changes and modifications can be made therein without departing from the spirit and scope thereof.

What is claimed is:

1. A heat sensitive recording paper comprising a support and a heat sensitive recording layer which contains a colorless or light colored electron-donating dye and a phenolic compound, said recording paper containing a sodium or potassium salt of a monovalent or divalent organic carboxylic acid having from 2 to 15 carbon atoms in the support, whereby the conductivity of the support is increased.

2. A heat sennsitive recording paper as in claim 1, wherein the sodium or potassium salt of the monovalent or divalent organic carboxylic acid has from 2 to 8 carbon atoms therein.

3. A heat sensitive recording paper as in claim 1, wherein the sodium or potassium salt of the monovalent or divalent organic carboxylic acid is used in an amount such that the sodium or potassium ion content is from 0.05 to 0.5 $g/m^2$.

4. A heat sensitive recording paper as in claim 3, wherein the sodium or potassium ion content is from 0.07 to 0.3 $g/m^2$.

5. A heat sensitive recording paper as in claim 1, wherein said sodium or potassium salt of said monovalent or divalent organic carboxylic acid is present only in the support.

* * * * *